US009072380B2

(12) United States Patent
Durgin

(10) Patent No.: US 9,072,380 B2
(45) Date of Patent: Jul. 7, 2015

(54) BRACKET ASSEMBLIES FOR ATTACHMENT TO FRAMING STUDS TO CREATE WORK SURFACE

(71) Applicant: Stephen W Durgin, Carbondale, CO (US)

(72) Inventor: Stephen W Durgin, Carbondale, CO (US)

( * ) Notice: Subject to any disclaimer, the term of this patent is extended or adjusted under 35 U.S.C. 154(b) by 63 days.

(21) Appl. No.: 13/953,353

(22) Filed: Jul. 29, 2013

(65) Prior Publication Data

US 2014/0027589 A1 Jan. 30, 2014

Related U.S. Application Data

(60) Provisional application No. 61/677,046, filed on Jul. 30, 2012.

(51) Int. Cl.

| | |
|---|---|
| ***A47B 96/02*** | (2006.01) |
| ***A47B 96/06*** | (2006.01) |
| ***A47B 13/00*** | (2006.01) |
| ***A47B 27/02*** | (2006.01) |
| ***A47B 96/07*** | (2006.01) |

(52) U.S. Cl.

CPC ..... *A47B 96/06* (2013.01); *A47B 13/003* (2013.01); *A47B 27/02* (2013.01); *A47B 96/07* (2013.01); *Y10T 29/49947* (2015.01)

(58) Field of Classification Search

CPC ..... A47B 23/00; A47B 96/02; A47B 96/028; A47B 96/024; A47B 96/022; A47B 96/063; A47B 96/06

USPC ..... 248/235, 240, 240.4, 241, 242, 243, 248/245, 246, 250, 188.1, 188.6, 188.4; 108/42

See application file for complete search history.

(56) References Cited

U.S. PATENT DOCUMENTS

| | | | | | |
|---|---|---|---|---|---|
| 107,706 | A | * | 9/1870 | Mudge | 248/235 |
| 749,670 | A | * | 1/1904 | Gardner | 248/242 |
| 762,540 | A | * | 6/1904 | Lewis | 248/241 |
| 1,069,000 | A | * | 7/1913 | Giles | 248/236 |
| 1,090,687 | A | * | 3/1914 | Coon | 248/242 |
| 1,636,185 | A | * | 7/1927 | Goodwin et al. | 248/245 |
| 1,712,974 | A | * | 5/1929 | Venard | 248/245 |
| 1,758,440 | A | * | 5/1930 | Goodwin | 248/245 |
| 2,332,477 | A | * | 10/1943 | Thornley | 182/87 |
| 2,379,752 | A | * | 7/1945 | Schultz | 403/299 |
| 2,414,538 | A | * | 1/1947 | Lamb | 182/113 |
| 2,483,758 | A | * | 10/1949 | Douglas | 248/242 |
| 2,577,979 | A | * | 12/1951 | Pierson et al. | 248/235 |
| 2,882,101 | A | * | 4/1959 | Michalak et al. | 248/235 |
| 3,473,774 | A | | 10/1969 | Riblet | |
| 3,485,382 | A | * | 12/1969 | Larson | 211/150 |
| 3,493,208 | A | | 2/1970 | Sato | |
| 3,710,734 | A | | 1/1973 | Bofferding et al. | |
| 4,100,858 | A | | 7/1978 | Bue | |
| 4,155,609 | A | | 5/1979 | Skafte | |
| 4,167,255 | A | * | 9/1979 | Benson | 242/129 |
| 4,448,380 | A | | 5/1984 | Huber-Krattiger | |
| 4,452,336 | A | * | 6/1984 | Sickler | 182/82 |
| 4,460,147 | A | * | 7/1984 | Macbain | 248/542 |

(Continued)

*Primary Examiner* — Nkeisha Smith

(74) *Attorney, Agent, or Firm* — Leyendecker & Lemire, PLLC

(57) ABSTRACT

A bracket/strut assembly that is connectable to wood or metal wall studs is described that when used in at least a pair provide a support structure for holding a flat board, such as drywall or plywood, in a horizontal or near horizontal orientation. In a typical application, embodiments of the bracket assemblies are used in combination with the board as a blueprint table at a construction site.

17 Claims, 5 Drawing Sheets

(56) References Cited

U.S. PATENT DOCUMENTS

| | | | | | |
|---|---|---|---|---|---|
| 4,509,711 | A | * | 4/1985 | Wallther | 248/235 |
| 4,673,060 | A | * | 6/1987 | Gregory | 182/82 |
| 4,688,658 | A | | 8/1987 | Stoner | |
| 4,730,738 | A | * | 3/1988 | Bartus et al. | 211/90.02 |
| 4,791,873 | A | | 12/1988 | Towfigh | |
| 4,805,863 | A | * | 2/1989 | Armstrong et al. | 248/243 |
| 4,984,763 | A | | 1/1991 | O'Donnell | |
| 4,998,484 | A | * | 3/1991 | Groetzinger | 108/42 |
| 5,381,738 | A | * | 1/1995 | Meyer | 108/42 |
| 5,503,358 | A | | 4/1996 | Lapp | |
| 5,513,574 | A | | 5/1996 | Collins | |
| 5,535,974 | A | * | 7/1996 | Savitski | 248/246 |
| 5,771,991 | A | | 6/1998 | Fresco | |
| 5,775,655 | A | * | 7/1998 | Schmeets | 248/240 |
| 5,865,410 | A | * | 2/1999 | Horen | 248/242 |
| 5,909,920 | A | * | 6/1999 | Dalinkiewicz | 296/24.4 |
| 5,967,478 | A | * | 10/1999 | Tynes | 248/241 |
| 6,026,932 | A | * | 2/2000 | Comp | 182/150 |
| 6,039,416 | A | | 3/2000 | Lambert | |
| 6,098,552 | A | | 8/2000 | Gunderson | |
| 6,113,202 | A | | 9/2000 | Germano | |
| 6,126,127 | A | | 10/2000 | Riblet | |
| 6,173,846 | B1 | * | 1/2001 | Anderson | 211/183 |
| 6,708,627 | B1 | | 3/2004 | Wood | |
| 7,210,414 | B1 | | 5/2007 | Barone | |
| 7,258,197 | B1 | * | 8/2007 | Wicks | 182/82 |
| 7,421,958 | B2 | | 9/2008 | Ciulla | |
| 7,464,652 | B2 | | 12/2008 | Hauck | |
| 7,717,376 | B2 | * | 5/2010 | Sparks, Jr. | 248/145 |
| 7,748,195 | B2 | * | 7/2010 | Keith | 52/745.21 |
| 8,016,137 | B2 | * | 9/2011 | Shaha | 211/103 |
| 8,042,782 | B2 | * | 10/2011 | Lippert et al. | 248/317 |
| 8,262,040 | B1 | * | 9/2012 | Haucke | 248/215 |
| 8,529,157 | B2 | * | 9/2013 | McKay | 405/220 |
| 2003/0226944 | A1 | | 12/2003 | Sode | |
| 2004/0032190 | A1 | | 2/2004 | Condas | |
| 2008/0283702 | A1 | * | 11/2008 | Ikerd | 248/228.1 |
| 2009/0200442 | A1 | | 8/2009 | Solis | |
| 2011/0010997 | A1 | * | 1/2011 | Kislov | 49/141 |
| 2011/0012000 | A1 | * | 1/2011 | Bulley | 248/241 |
| 2011/0315838 | A1 | * | 12/2011 | Abell | 248/205.1 |

* cited by examiner

BRACKET ASSEMBLIES FOR ATTACHMENT TO FRAMING STUDS TO CREATE WORK SURFACE

CROSS-REFERENCE TO RELATED APPLICATIONS

This application is a claims priority to U.S. Provisional Patent Application No. 61/677,046 filed Jul. 30, 2012 having one common inventor. The full disclosure of this application is incorporated herein by reference.

FIELD OF THE INVENTION

The present invention pertains to brackets attachable to wall studs for supporting a work surface.

BACKGROUND

Blueprints and other construction documents are required at a typical construction site. Further architects, designers and contractors will frequently refer to these documents to ensure the construction project is proceeding as planned. Suitable tables or other elevated work surfaces are often not available on which to place the documents either to hold them or to provide a location for viewing them as necessary.

Storing the documents at a location elevated above the floor is desirable so they do not get wet, covered in construction debris or otherwise damaged. Accordingly, the documents may be hung from a nail driven into a stud, or resting on top of a tool chest or other elevated surface. When it is necessary to view the plans, they are often spread out on a clean and dry section of a floor with the viewers kneeling as necessary in front of or around the plans.

Occasionally, a construction worker(s) may build a table using scrap two by fours whether attached to a wall or self-supporting, but this activity takes away from the time the worker(s) spend on the associated project.

DETAILED DESCRIPTION

Figure 1:
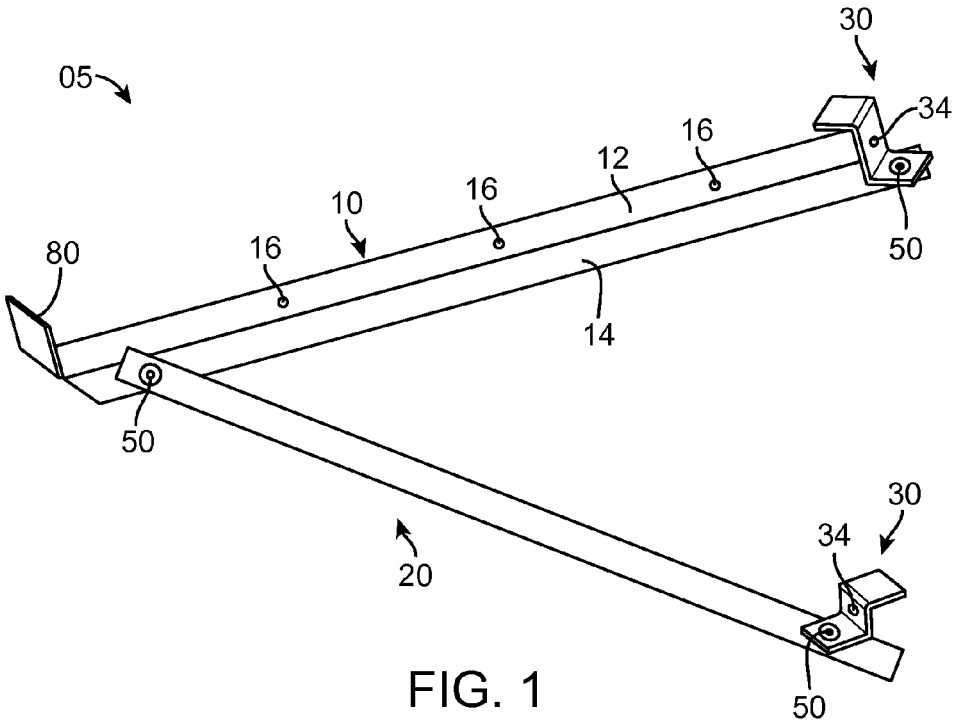
FIG. 1 is an isometric view of a bracket assembly according to an embodiment of the present invention.

Embodiments of the present invention comprise a bracket/strut assembly that is connectable to wood or metal wall studs that when used in at least a pair provide a support structure for holding a flat piece of substantially rigid material (hereafter "board"), such as drywall or plywood, in a horizontal or near horizontal orientation. In a typical application, embodiments of the bracket assemblies are used in combination with a board as a blueprint table at a construction site.

One embodiment of the bracket assembly comprises a rigid support arm pivotally coupled to a rigid support strut. The distal ends of each of the strut and arm include pivoting brackets/connectors attached thereto. This construction allows the bracket assemblies to be quickly and easily placed around a stud and infinitely adjusted for both the height and angle of support arm on which a board rests. The configuration of a pair of spaced apart pivoting brackets causes the brackets to frictionally interface with and bite into an associated stud when weight is applied, such as from the board, to the support arm.

In at least one embodiment the interfacing of the various components in conjunction with the support arm, allow the support arm to be set at a variety of different angles from substantially horizontal to sloping downwardly from the interface with the stud. Accordingly, a user can pick the most desirable angle for viewing and using the documents placed on the resulting work surface.

Also in at least one embodiment, the distal end of the support arm includes an upwardly extending lip or stop. The lip acts as a stop to prevent the board when placed thereon from sliding off of the arm when the arm is set at a downwardly angle. In some variations the lip is also tall enough to extend vertically above the board and act as a stop to prevent blueprints from sliding off the assembled table when set at an angle. Other variations whether including the lip or not can include fastener holes in the support arm through which screws or other fasteners can be used to secure a board in place. As can be appreciated, fastening the board to two spaced bracket assemblies effectively ties the three components together and provides lateral stability to the resulting table.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase. The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. Concerning angular measurements, "about" or "generally" refers to +−10 degrees and "substantially" refers to +−5.0 degrees unless otherwise indicated. It is to be appreciated that not all uses of the above terms are quantifiable such that the referenced ranges can be applied.

An Embodiment of a Bracket Assembly

Figure 2:
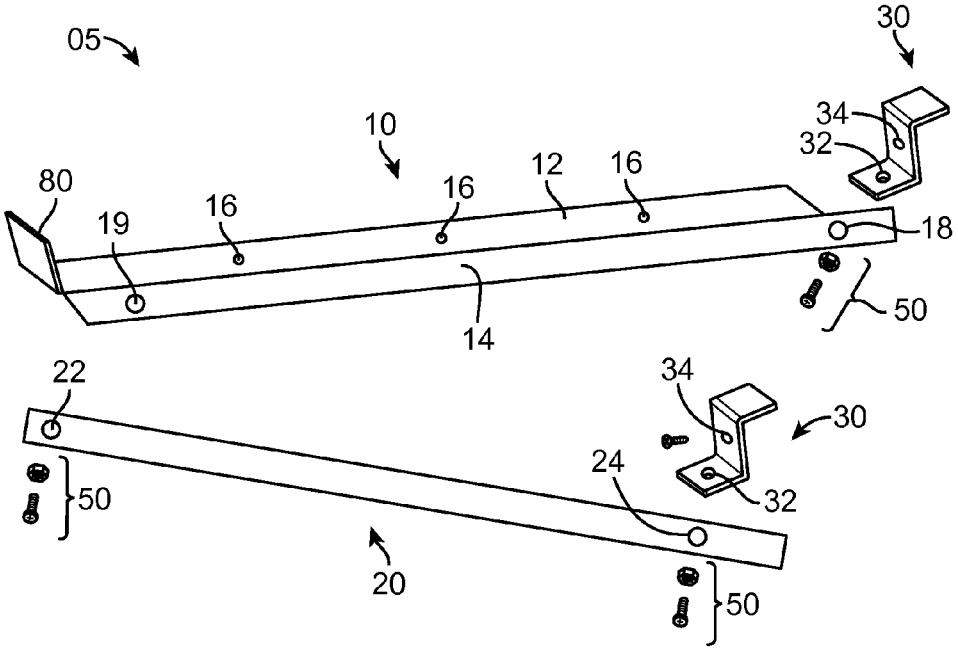
FIG. 2 is an exploded view of the bracket assembly according to an embodiment of the present invention.

FIGS. 1 & 2 illustrate an embodiment of a bracket assembly. The assembly 05 typically includes: (i) a rigid elongated support arm 10; (ii) a rigid elongated support strut 20; (iii) a pair of rigid S-brackets 30; and (iv) several sets of fasteners 50 to pivotally couple the various pieces together.

The illustrated elongated support arm 10 comprises L-channel having a substantially vertical leg 14 and a substantially horizontal leg 12. The support arm is typically made of an aluminum alloy although other materials, such as steel and reinforced plastic, can be used as well. Additionally, the other structural configurations can be used in place of the L-channel, such as but not limited to C-channel.

In at least some variations, a stop 80 comprising a generally vertically upwardly extending piece of aluminum (or other material) can be affixed to the distal end of the horizontal leg for the primary purpose of preventing a board resting on the support from sliding off of it when the assembly is in use. The stop can comprise a distinct piece that is welded to the end of the L-channel. Alternatively, the stop can comprise an upwardly bent portion formerly of the horizontal leg.

Figure 3A:
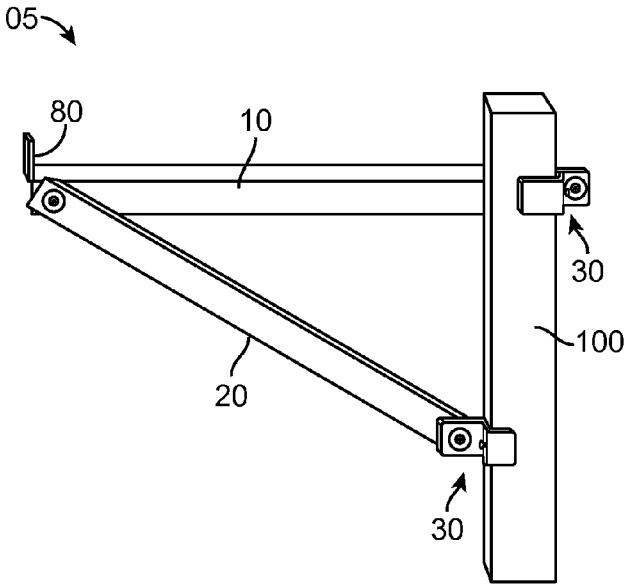
FIG. 3*a* is an isometric front view of the bracket assembly installed on a framing stud according to an embodiment of the present invention.
Figure 3B:
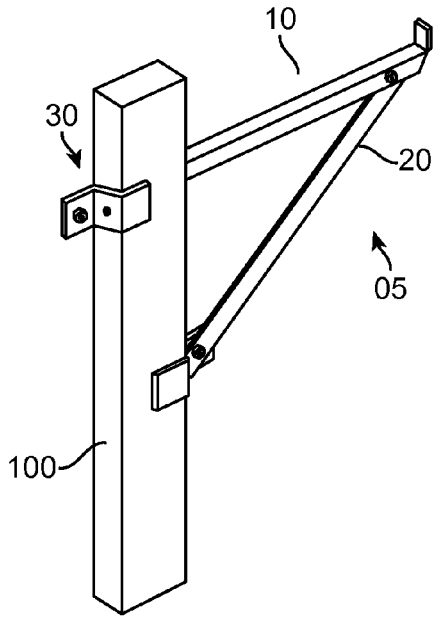
FIG. 3*b* is an isometric rear view of the bracket assembly installed on a framing stud according to an embodiment of the present invention.

Near the proximal end of the support arm, a portion of the L-channel's generally horizontal leg 12 is removed to facilitate better access to a top S-shaped bracket 30 and the associated fastener set 50 (see FIG. 3*b*) thereby creating a rearmost portion of the support arm wherein the vertical leg 14 extends rearwardly beyond the end of the horizontal leg. Similarly, near the distal end of the support arm a portion of the vertical leg 14 can be removed and/or beveled creating front end wherein the horizontal leg extends forwardly beyond the end of the vertical leg.

Several fastener holes 18 & 19 are provided through the vertical leg 14 of the L-channel: the hole 18 at the proximal end facilitating the pivotal connection of a top S-shaped bracket 30 with the support arm 10 using a fastener set 50; and the hole 19 proximate the distal end facilitating connection to a support strut 20 by way of another fastener set 50.

Several additional holes 16 may be provided through the horizontal leg 12 in some variations to facilitate the receipt of several fasteners there through and into an overlying board to secure the board to the support arm 10. By securing a board to the support arm in two or more places for each of at least two bracket assemblies used to construct a table, the lateral rigidity of the table is increased.

The support strut 20, as shown, comprises aluminum flat bar stock although other materials and configurations can be used. It includes a fastener hole 22 near its distal end to pivotally couple with the support arm 10 with an associated fastener set 50. Near the support struts proximate end a second fastener hole 24 is provided through which the strut is pivotally coupled to a second or bottom S-shaped bracket 30 by way of yet another fastener set 50.

Figure 7:
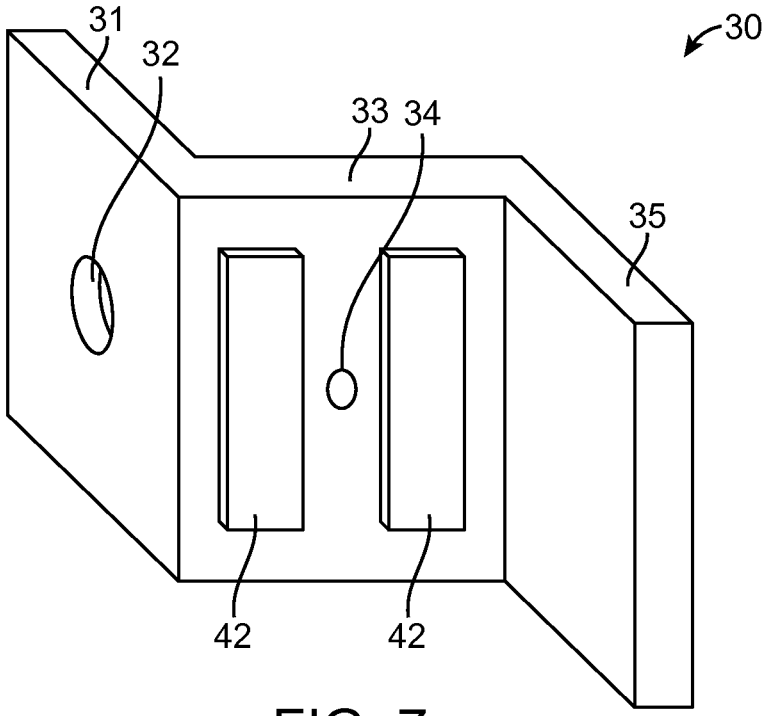
FIG. 7 is an isomeric view of an S-bracket according to an embodiment of the present invention.

The two substantially similar S-shaped brackets 30 also typically comprise aluminum alloy although as with the other components these can be comprised of other materials. The illustrated brackets are typically cut from extruded aluminum s-shaped stock, but can be fabricated by other means as well. With reference to FIG. 7, a planar first leg portion 31 of each bracket includes a fastener hole 32 provided approximately in the center of the first leg portion to receive the associated fastener set 50 and pivotally couple the bracket to the respective support arm 10 or support strut 20. In some variations, a hole 34 may also be provided in the planar body portion 33 of the bracket that spans between and couples the respective first and second planar leg portions 31&35. Within this hole a small securing screw can be placed that when tightened mechanically helps fix the bracket to an underlying stud 100. In many, if not most uses, a securing screw is not necessary to hold the bracket assembly securely in place; however, the screw can be useful when a table is intended to remain in place for a significant period of time or where the assembly may be susceptible to slipping.

In some variations of the S-bracket 30 as shown in FIG. 7 includes one or more rubber/elastomeric strips 42 are provided on the inside face of the body portion 33. The rubber strips have a higher coefficient of friction than the underlying aluminum, and as such act to grip the underlying stud. The strips are particularly effective in gripping steel studs. As can be appreciated the shape and configuration of the elastomeric strips can vary substantially.

Each of the various fastener sets 50 used to couple the various assembly components together typically comprise a threaded bolt, an associated threaded nut and optionally one or more washers (not shown). In variations, however, the fastener sets can also comprise but are not limited to rivets, threadless bolts, bushings and cotter pins.

In its assembled form as illustrated in FIG. 1, the support arm 10 near its distal end is pivotally secured to the support strut 20 near its distal end by way of a fastener set 50. A top S-bracket 30 is pivotally secured to the proximal end of the support arm using another fastener set 50. In its operative orientation the second leg portion 35 (spaced from the first leg portion 31 by the body portion 33) in conjunction with the body portion and the vertical wall 14 of the support arm form a C-shape that faces generally towards the bracket assembly's distal end.

A second S-bracket 30 is pivotally secured to the support strut 20 near its distal end by way of a fastener set 50. In its operative orientation the second leg portion 35 (spaced from the first leg portion 31 by the body portion 33) in conjunction with the body portion and the sidewall of the support strut form a C-shape that faces generally away from the bracket assembly's distal end.

An Embodiment of a Table that Uses a Pair of Bracket Assemblies and a Method of Assembling Same.

Figure 4:
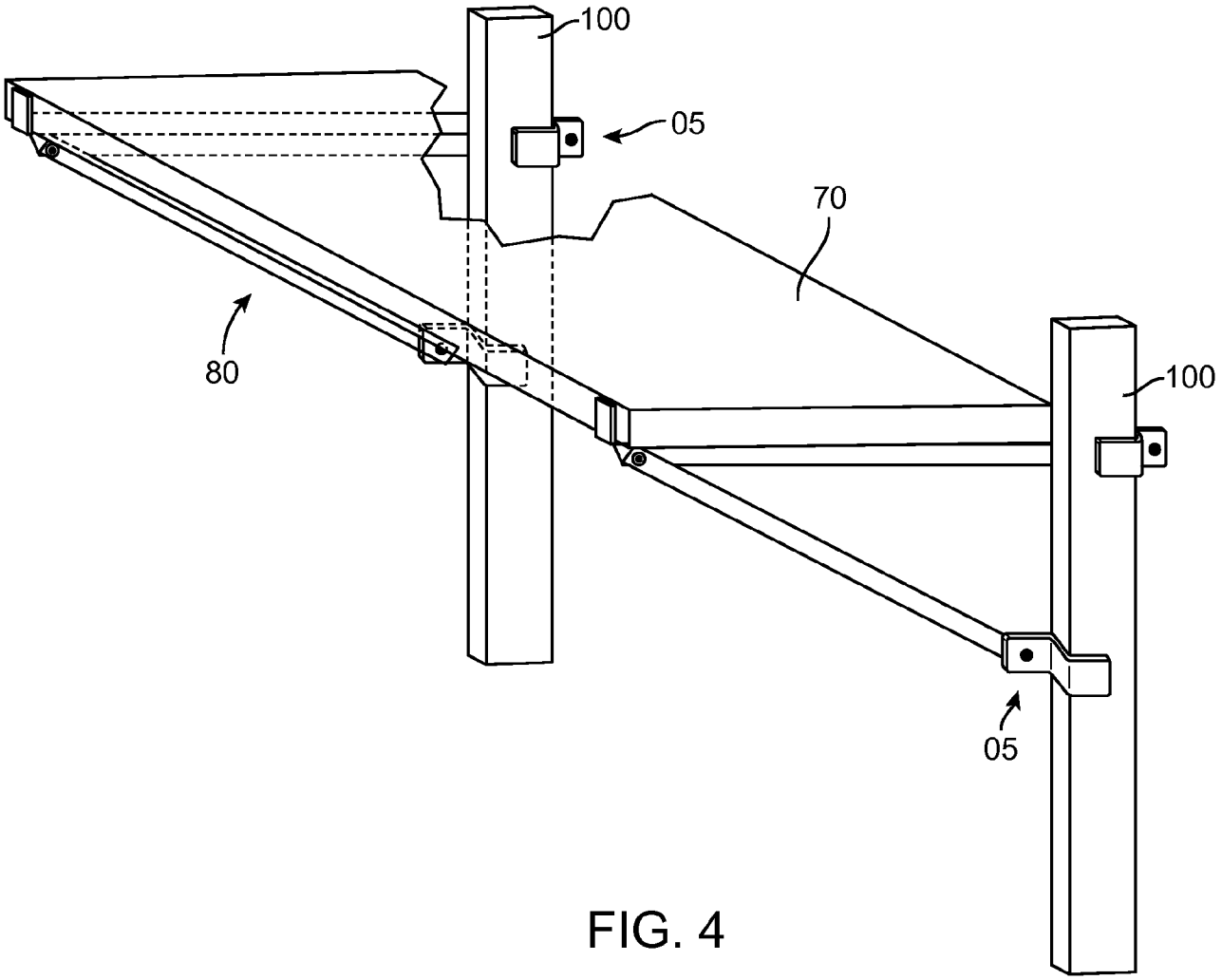
FIG. 4 is an isometric of a table comprised of two bracket assemblies according to an embodiment of the present invention.
Figure 5:
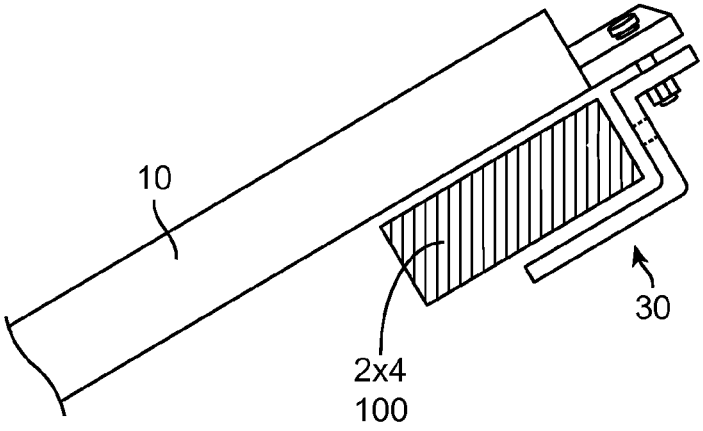
FIG. 5 is an isometric partial view of a bracket assembly installed on a framing stud showing the interface between the support arm and the stud according to an embodiment of the present invention.
Figure 6:
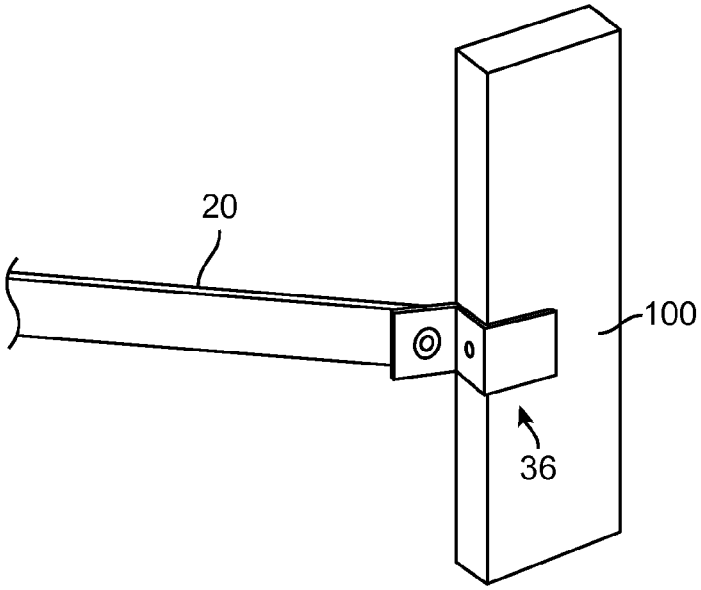
FIG. 6 is an isometric partial view of a bracket assembly installed on a framing stud showing the interface between the support strut and the stud according to an embodiment of the present invention.

FIGS. 3*a*, 3*b*, 5 & 6 illustrate a bracket assembly 05 installed on a framing stud 100. FIG. 4 illustrates a pair of bracket assemblies installed on spaced apart studs with a board 70 resting on the bracket assemblies to form a table 80.

To set up a table 80 a suitable location is identified having at least two suitable framing studs 100 around which each of the two bracket assemblies will attach. As can be appreciated by one of ordinary skill in the art, the process of erecting a table can vary and that the sequence provided herein is merely exemplary. First, the user wraps the top S-bracket 30 around the back side of an identified stud at a desired height. When properly installed an inside surface of the body plate portion 33, which can be covered in one or more strips 42 of elastomeric material, is placed in contact with the back side of the stud. The left and right lateral sides of the stud are bounded by the second (or upper) leg 35 of the S-bracket and the vertical leg 14 of the support arm form a C-shape.

While holding the support arm 10 at a desired angle, the user swings the support strut 20 towards the stud and secures the lower bracket 30 around the same stud with the C-shaped formed by the bracket plates and the sidewall of the strut facing away from the distal end of the bracket in the opposite direction as the C-shape formed by the top bracket and the support arm. The inside surface of the body plate 33 with or without elastomeric strips 42 will be in contact with the front side of the stud and bounded by the bracket's second leg 35 and the side of the support strut. The user then may apply a slight amount of downward force to the distal end of the support arm to help set the assembly in place.

As necessary the user can adjust the bracket assembly 05 to ensure it is at the desired height and angle. Given the configuration of the bracket assembly and its multiple pivotal connections, the angle of the support arm 10 can be adjust to an infinite number of angular positions between horizontal and 45 degrees below horizontal. More preferably, the bracket assembly is typically adjusted so that the support arm is horizontal to up to 30 degrees below horizontal.

The weight of the support arm 10 and the assembly 05 as a whole cause the top bracket 30 at the body plate 33 inside surface in contact with the back side of the stud to be pulled into closer contact therewith. The weight of the support arm further pushes down on the support strut 20 driving the body plate portions 33 of the bottom S-bracket 30 into the front side of the stud. The pivotal connections of the S-brackets permit the inside surfaces of the respective body plate portions to contact the respective surfaces of the stud. Acting together, any weight applied to the support arm and the weight of the arm itself pulls the respective body plate portions tighter against opposing sides of the stud and effectively locks the assembly in place with friction inhibiting the assembly from sliding down the stud.

In some variations wherein the bracket includes the fastener hole 34 on the body plate 33 of the S-brackets 30, a user may secure one or both of the brackets into the stud. This is not typically required, but may be desired in those applications where the table is to remain in place for a significant period of time or those applications wherein the framing stud is made of steel and has a lower coefficient of friction than wood. However, the use of elastomeric strips 42 on the S-bracket nearly eliminates all slippage issues on all types of studs including steel studs.

After the first bracket assembly 05 is installed, the user installs a second bracket assembly 05 on a stud 100 spaced from the first. In a typical wall, studs are positioned 16" on center, and accordingly, the second bracket assembly would most typically be placed on a stud spaced about 32" from the stud having the first bracket assembly. The second bracket assembly is installed in substantially the same manner as the first with care being taken to place the bracket at the same height as the first with the support arm extending at substantially the same angle as the first.

After the bracket assemblies 05 have been secured to the studs 100 at desired locations, a board 70 that is longer in width than the bracket spacing is placed on the brackets with the stops 80 preventing the board from sliding off of the support arms especially when the support arms 10 are angled. The type and nature of a particular board varies with what is available at the job site. Typically, a user will pick scrap sheet in any available material including but not limited to drywall board, plywood, orientated strand board and chipboard. In certain installations, small fasteners may be driven into the board from underneath the support arm through the provided fastener holes 16 in the horizontal leg 12. By securing the board to the bracket assemblies, the lateral stability of the table 80 is improved and the possibility that the board could laterally slide off of one or both bracket assemblies is also reduced.

The foregoing table is described as one using two bracket assemblies. As can be appreciated, tables using three or more bracket assemblies are also contemplated with these tables being assembled in substantially the same manner save for the setting of additional bracket assemblies.

Alternative Embodiments and Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

We claim:

1. A bracket assembly for attachment to a wall stud for use in conjunction with one or more additional similar brackets to create a support for receiving a board thereon and creating a work surface, the bracket assembly comprising:

a support arm adapted to receive the board thereon, the support arm having a support arm proximal end and a support arm distal end;

an elongated strut, the elongated strut having an elongated strut proximal end and an elongated strut distal end, the elongated strut distal end being pivotally attached to the support arm proximate the support arm distal end;

a first S-shaped bracket, the first S-shaped bracket being pivotally attached to the support arm near the support arm proximal end, the first S-shaped bracket being configured to form a C-shaped recess facing generally towards the support arm; and a second S-shaped bracket, the second S-shaped bracket being pivotally attached to the elongated strut near the elongated strut proximal end, the second S-shaped bracket being configured to form a C-shaped recess facing generally away from the elongated strut;

wherein the first S-shaped bracket and the second S-shaped bracket are configured to frictionally and removably secure the assembly to the wall stud;

wherein each of the first and second S-shaped brackets comprises (i) a substantially planer body portion having first and second edges, (ii) a substantially planer first leg portion extending orthogonally from the body portion at the first edge, and (iii) a substantially planer second leg portion extending orthogonally from the body portion at the second edge in substantially an opposite direction as the first leg portion.

2. The bracket assembly of claim 1, wherein the support arm comprises L-channel.

3. The bracket assembly of claim 1, wherein the support arm includes an end stop secured to the support arm distal end, the end stop extending upwardly in a direction orthogonal to an elongated axis of the support arm.

4. The bracket assembly of claim 1, wherein the support arm is comprised of an aluminum alloy.

5. The bracket assembly of claim 1, wherein a first leg fastener hole is provided through the first leg portion of the first and second S-shaped brackets.

6. The bracket assembly of claim 5, wherein the elongated strut is attached to the support arm by way of a first threaded fastener, the first S-shaped bracket is attached to the support arm by way of second threaded fastener passing through the first leg fastener hole of the first bracket, and the second S-shaped bracket is attached to the elongated strut by way of a third threaded fastener passing through the first leg fastener hole of the second bracket.

7. The bracket assembly of claim 5, wherein the body portion of each of the first and second S-shaped brackets includes a planer inside surface with one or more pieces of elastomeric sheet secured to the inside surface.

8. The bracket assembly of claim 5, wherein the body portion of each of the first and second S-shaped brackets includes a body fastener hole passing therethrough.

9. The bracket assembly of claim 5, wherein the support arm comprises L-channel and, wherein the L-channel includes two legs, a substantially vertical leg and a substantially horizontal leg, and wherein the horizontal leg includes two or more horizontal leg fastener holes extending therethrough.

10. The bracket assembly of claim 1, wherein the first and second S-shaped brackets are comprised of an aluminum alloy.

11. A table assembly for erection on at least a pair of framing studs, the table assembly comprising at least two bracket assemblies and a substantially planer board, wherein each bracket assembly comprises a support arm adapted to receive the board thereon, the support arm having a support arm proximal end and a support arm distal end; an elongated strut, the elongated strut having an elongated strut proximal end and an elongated strut distal end, the elongated strut distal end being pivotally attached to the support arm proximate the support arm distal end; a first S-shaped bracket, the first S-shaped bracket being pivotally attached to the support arm near the support arm proximal end, the first S-shaped bracket being configured to form a C-shaped recess facing generally towards the support arm; and a second S-shaped bracket, the second S-shaped bracket being pivotally attached to the elongated strut near the elongated strut proximal end, the second S-shaped bracket being configured to form a C-shaped recess facing generally away from the elongated strut; wherein the first S-shaped bracket and the second S-shaped brackets bracket are configured to frictionally and removably secure the bracket assembly to a wall stud; wherein each of the first and second S-shaped brackets comprises (i) a substantially planer body portion having first and second edges, (ii) a substantially planer first leg portion extending orthogonally from the body portion at the first edge, and (iii) a substantially planer second leg portion extending orthogonally from the body portion at the second edge in substantially an opposite direction as the first leg portion.

12. A method of assembling a table assembly using at least two bracket assemblies, wherein each bracket assembly comprises a support arm adapted to receive a board thereon, the support arm having a support arm proximal end and a support arm distal end; an elongated strut, the elongated strut having an elongated strut proximal end and an elongated strut distal end, the elongated strut distal end being pivotally attached to the support arm proximate the support arm distal end; a first S-shaped bracket, the first S-shaped bracket being pivotally attached to the support arm near the support arm proximal end, the first S-shaped bracket being configured to form a C-shaped recess facing generally towards the support arm; and a second S-shaped bracket, the second S-shaped bracket being pivotally attached to the elongated strut near the elongated strut proximal end, the second S-shaped bracket being configured to form a C-shaped recess facing generally away from the elongated strut; wherein the first S-shaped bracket and the second S-shaped brackets bracket are configured to frictionally and removably secure the bracket assembly to the framing studs; wherein each of the first and second S-shaped brackets comprises (i) a substantially planer body portion having first and second edges, (ii) a substantially planer first leg portion extending orthogonally from the body portion at the first edge, and (iii) a substantially planer second leg portion extending orthogonally from the body portion at the second edge in substantially an opposite direction as the first leg portion, the method comprising:

identifying a framed wall comprising a plurality of framing studs without drywall or other wall covering installed thereon and choosing at least two spaced apart studs on the wall to which the table assembly is to be secured, each framing stud including a front side, a back side, and left and right lateral sides;

placing the first S-shaped bracket of a first bracket assembly of the at least two bracket assemblies around a first framing stud of the at least two spaced apart studs;

while holding the support arm of the first bracket assembly at approximately a desired angle relative to horizontal, placing the second S-shaped bracket of the first bracket assembly around the first framing stud at a location underneath the first bracket;

placing the first S-shaped bracket of a second bracket assembly of the at least two bracket assemblies around a second framing stud of the at least two spaced apart studs;

while holding the support arm of the second bracket assembly at approximately a same angle relative to horizontal as the support arm of the first bracket assembly, placing the second S-shaped bracket of the second bracket assembly around the second framing stud at a location underneath the first S-shaped bracket of the second bracket assembly; and placing a board over and on top of the support arms of the first bracket assembly and the second bracket assembly.

13. The method of claim 12, further comprising adjusting the first and second bracket assemblies until the support arm of the first bracket assembly and the support arm of the second bracket assembly are each at a similar angle of 0 to minus 30 degrees relative to horizontal.

14. The method of claim 12, wherein the support arm of each of the first and second bracket assemblies includes a plurality of generally vertically-extending support arm fastener holes, and the method further comprises securing the board to the respective bracket assemblies using a plurality of fasteners received through the plurality of generally vertically-extending support arm fastener holes of the first and second bracket assemblies.

15. The method of claim 12, wherein the first and second S-shaped brackets each comprises (i) the substantially planer body portion having first and second edges, (ii) the substantially planer first leg portion extending orthogonally from the body portion at the first edge, and (iii) the substantially planer second leg portion extending orthogonally from the body portion at the second edge in substantially an opposite direction as the first leg portion, wherein each bracket is pivotally attached to the respective support arm or elongated strut at the first leg portion wherein:

said placing the first S-shaped bracket of the first bracket assembly around the first framing stud further comprises positioning the first bracket with (a) an inside surface of the body portion being adjacent the back side of the first framing stud, and (b) the inside surface of the body portion being adjacent one of the left and right lateral sides; and said placing the second S-shaped bracket of the first bracket assembly around the first framing stud further comprises positioning the second bracket with (1) an inside surface of the body portion being adjacent the back side of the first framing stud, and (2) the inside surface of the body portion being adjacent one of the left and right lateral sides.

16. A bracket assembly for attachment to a wall stud for use in conjunction with one or more additional similar brackets to create a support for receiving a board thereon and creating a work surface, the bracket assembly comprising:

a support arm adapted to receive the board thereon, the support arm having a support arm proximal end and a support arm distal end, the support arm comprising L-channel and an end stop secured to the support arm distal end, the end stop extending upwardly in a direction orthogonal to an elongated axis of the support arm;

an elongated strut, the elongated strut having an elongated strut proximal end and an elongated strut distal end, the elongated strut distal end being pivotally attached to the support arm proximate the support arm distal end;

a first S-shaped bracket, the first S-shaped bracket being pivotally attached to the support arm near the support arm proximal end, the first S-shaped bracket being configured to form a C-shaped recess facing generally towards the support arm, the first S-shaped bracket including (i) a substantially planer body portion having first and second edges, (ii) a substantially planer first leg portion extending orthogonally from the body portion at the first edge, and (iii) a substantially planer second leg portion extending orthogonally from the body portion at the second edge in substantially an opposite direction as the first leg portion, wherein a first leg fastener hole is provided through the first leg portion; and a second S-shaped bracket, the second S-shaped bracket being pivotally attached to the elongated strut near the elongated strut proximal end, the second S-shaped bracket being configured to form a C-shaped recess facing generally away from the elongated strut, the second S-shaped bracket including (i) a substantially planer body portion having first and second edges, (ii) a substantially planer first leg portion extending orthogonally from the body portion at the first edge, and (iii) a substantially planer second leg portion extending orthogonally from the body portion at the second edge in substantially an opposite direction as the first leg portion, wherein a first leg fastener hole is provided through the first leg portion;

wherein the elongated strut is attached to the support arm by way of a first threaded fastener, the first bracket is attached to the support arm by way of second threaded fastener passing through the fastener hole of the first bracket, and the second bracket is attached to the elongated strut by way of a third threaded fastener passing through the first leg fastener hole of the second bracket.

17. The bracket assembly of claim 16, further wherein each of the first and second S-shaped brackets further comprise one or more elastomeric strips, the elastomeric strips being adhered to an inside surface of the body portion.

* * * * *